US005927339A

United States Patent [19]

Ellis et al.

[11] Patent Number: 5,927,339

[45] Date of Patent: Jul. 27, 1999

[54] AIR TURNING ASSEMBLY WITH SELF-GRIPPING VANES

[75] Inventors: Stanley Jerome Ellis, Orange; Donald Harvey Siiter, Yorba Linda, both of Calif.

[73] Assignee: ECO Products, Inc. A California Corporation, Orange, Calif.

[21] Appl. No.: 08/912,385

[22] Filed: Aug. 18, 1997

[51] Int. Cl.[6] ..... F15D 1/04

[52] U.S. Cl. ..... 138/39; 138/37

[58] Field of Search ..... 138/39, 37

[56] References Cited

U.S. PATENT DOCUMENTS

| | | | |
|---|---|---|---|
| 3,381,713 | 5/1968 | Jacobsen | 138/39 |
| 3,405,737 | 10/1968 | Harper | 138/39 |
| 3,494,379 | 2/1970 | Hinden | 138/39 |
| 4,467,829 | 8/1984 | Myers | 138/39 |
| 4,586,540 | 5/1986 | DeLord | 138/39 |
| 4,641,684 | 2/1987 | DeLord | 138/39 |
| 5,529,092 | 6/1996 | Arnoldt | 138/37 |

*Primary Examiner*—Denise L. Ferensic
*Assistant Examiner*—James F. Hook
*Attorney, Agent, or Firm*—William L. Chapin

[57] ABSTRACT

An air turning vane and rail assembly for promoting laminar air flow in angled duct work transition sections includes longitudinally spaced apart air turning vanes transversely disposed between a pair of flat rails. Each turning vane is a hollow double-plate airfoil having a convex front airfoil plate, and a concave rear airfoil plate joined at their edges. Each rail has a plurality of longitudinally spaced apart, upstanding tabs each having an upper trapezoidally-shaped portion and a lower rectangularly-shaped pedestal portion. Each tab has a pair of laterally opposed, outwardly and downwardly angled edge walls, each joined at its lower end to a vertically disposed pedestal edge wall. The width of the pedestal is greater than the maximum lateral spacing between the front and rear airfoil plates. Thus, when a rail tab is inserted into an entrance opening between front and rear vane plates, wedging action of the angled tab side walls on the inner surfaces of the plates deforms the end portions of the plates to a flatter, less curved contour, causing the vane to firmly grip the tab. A protuberance protruding forward from the rear airfoil plate towards the front airfoil plate snaps into an aperture provided through the tab near its base, when a vane is pushed down on a tab sufficiently far, causing locking engagement in addition to a gripping engagement between vane and rail.

28 Claims, 9 Drawing Sheets

AIR TURNING ASSEMBLY WITH SELF-GRIPPING VANES

BACKGROUND OF THE INVENTION

A. Field of the Invention

The present invention relates to duct work used to convey air for heating, ventilating or air conditioning structures such as commercial and industrial buildings, as well as residences. More particularly, the invention relates to air turning structures utilized at locations in the duct work where air flow direction changes.

B. Description of Background Art

Flowing air used to ventilate, heat, or cool buildings is typically routed through elongated, straight rectangular cross-section tubes or ducts, which are collectively referred to as duct work. Changes in the orientation or bearing of ducts is usually performed by means of an angled transition section or elbow, typically bent at 90 degrees and having rectangular or circular openings for attachment to separate ducts oriented at 90 degrees with respect to one another. When air flowing through a duct impacts the side wall of an elbow section disposed perpendicularly to the flow direction, substantial turbulence is created in the flowing air mass, even when the flow velocity is relatively modest. This turbulence impedes air flow, causing an increase in static pressure and pressure loss coefficients, thus necessitating the use of larger blowers that consume increased drive power, to maintain a given air flow rate at the outlet of the elbow section. Moreover, undesirable vibration and noise may be generated within the duct work, if the turbulence is sufficiently great.

For the reasons stated above, ventilation elbows or transition sections are often constructed to include means for minimizing turbulence, usually by encouraging laminar flow within the elbow. Thus, ventilation elbows constructed to minimize turbulence typically employ a plurality of curved, parallel blades or turning vanes spaced apart at regular intervals, to promote laminar air flow where the direction of air flow changes within the elbow. Typical turning vane assemblies use a plurality of curved sheet metal vanes disposed between a pair of flat, parallel metal sheets, often referred to as rails. The assembly is secured within an angled transition section or elbow.

Turning vane assemblies which employ a variety of techniques for fastening turning vanes to rails has been disclosed in the following U.S. patents:

Steffens, U.S. Pat. No. 2,292,246, Aug. 4, 1942, Duct Turn: Discloses curved double wall non-metallic duct turns or vanes having a metal insert with a tab that fits into slots cut longitudinally inward from the diagonal end wall of a duct shell, the tab having a protruding finger which is bent flush with the diagonal end wall.

Speiser, U.S. Pat. 2,826,221, Mar. 11, 1958, Duct Devices: Discloses duct devices that utilize vanes in the shape of a rectangular plate curved to form a partition wall or guide plate having parallel top and bottom horizontal edges and parallel vertical side edges. Both the top edge and bottom edge of each vane have formed therein a pair of vertically disposed cuts, forming at each cut two tongues, for a total of four tabs. This vane construction requires the provision in each plate or rail of a pair of longitudinally disposed channels or grooves having a V-shaped transverse cross-section The grooves are formed by downwardly converging walls intersecting on fold line. Each groove or channel has formed therein a plurality of longitudinally spaced apart obliquely disposed slots to receive a pair of tongues, which must be peened over in opposite directions flush with the bottom walls of the V-shaped groove to retain a vane in position between the rails.

Gracer, U.S. Pat. No. 2,861,597, Nov. 25, 1958, Air Guide Device: Discloses single and double wall turning vanes secured in slots formed in the bottoms of dimples protruding inward from rails, by deforming lateral edge walls of the vanes protruding outwards through the slots.

Perlin, U.S. Pat. No. 2,884,956, May 5, 1959, Air Guide Device: Discloses flanged, slotted cup-shaped members inserted through, holes formed in a pair of opposed side plates, to secure between the side plates turning blades positioned in the slots.

Gracer, U.S. Pat. No. 2,959,195, Nov. 8, 1960, Air Guide Device: Discloses an air turning assembly having a plurality of curved, rectangular plan view turning vanes or blades that are secured to a pair of rails by crimping opposite lateral edges of the blades protruding outwards through slots in inwardly extending protuberances formed in the rails.

Chesser, U.S. Pat. No. 3,050,160, Aug. 21, 1962, Sheet Metal Connection And Method For Effecting Same: Discloses a sheet metal connection employing a tongue protruding perpendicularly from a first plate inserted through a slot in a second plate, deformations being formed outwards from the plane of the tongue to lock it in place relative to the second plate.

Noll, U.S. Pat. No. 3,075,450, Jan. 29, 1963, Cap Assembly: Discloses a hollow tubular cap assembly having the shape of the frustrum of a cone, connectable to a cylindrical tube by extending flexible straps.

Bohannon, U.S. Pat. No. 3,144,204, Aug. 11, 1964, Centrifugal Blower Wheel: Discloses a centrifugal blower wheel having double-wall, air-foil shaped blades having a plurality of tabs protruding from opposite straight side walls thereof, the tabs on the two walls of each blade being inserted into first and second groups of slots provided through front and rear circular end plates, and bent over to retain the blades in place.

Olmsted, et al., U.S. Pat. No. 3,224,668, Dec. 21, 1965, Blower Wheel Wedged End Blade Mounting: Discloses curved blower wheel blades attachable to annular side rings by a central finger or tongue protruding from opposite short lateral edges of the blade. The fingers are bent into a V-shape, inserted into semi-circular or triangular-shaped holes through the side rings, and bent over to retain the blades in the rings.

Jacobsen, U.S. Pat. No. 3,381,713, May 7, 1968, Turning Vane And Rail Construction: Discloses double-wall, airfoil-shaped turning vanes having formed in the inner side of one wall a pair of cylindrically-shaped passageways disposed perpendicularly inwards from the outer lateral edge of the wall. Headed pins or nails are driven through holes provided in a pair of parallel side rails into the passageways, to secure the vanes to the rails.

Harper, U.S. Pat. No. 3,405,737, Oct. 15, 1968, Duct Device: Discloses double wall vanes secured in slots cut in inwardly protruding depressions in opposed side rails.

Hinden, U.S. Pat. No. 3,494,379, Feb. 10, 1970, Air Turning Assembly And Mounting Rail: Discloses an air turning assembly which employs turning vanes formed of glass fiber impregnated with a polymer and inserted through curved apertures or sockets punched in U-cross section rails. The sockets are outlined by outwardly deflected, spaced tabs or shoulder portions which are compressed by a cam lock against the protruding portion of a vane, thereby securing the vane to the rail.

Hinden, U.S. Pat. No. 3,602,262, Aug. 31, 1971, Air Turning Assembly: Discloses an air turning assembly utilizing fibrous, compressible vane members secured to a pair of parallel rails between the sides of a U-shaped clamp protruding inward from a rail and secured thereto.

Myers, U.S. Pat. No. 4,467,829, Aug. 28, 1984, Turning Vane Rail: Discloses a rail for mounting sheet metal turning vanes that includes a sheet and integral vane guides extending generally perpendicularly away from the plane of the sheet. Each vane guide is a plate slit from the sheet except for one edge along which the plate is bent. The plate is adapted to be positioned adjacent to a wall of the vane. An access aperture, partially located in the sheet and partially located in the plate is adapted to allow access to a portion of the vane wall for contact by a striking tool. A blow from the tool splits the sheet metal vane wall to form tabs which are folded through the aperture, which securely attaches the wall to the rail.

DeLord U.S. Pat. No. 4,641,684, Feb. 10, 1987, Rail For An Air Turning Vane Assembly: Discloses an air turning vane assembly in which the vanes are attached to tabs formed in each rail by integral locking clips formed upon the rail tabs. The rail assembly is constructed from rails having cutout portions adapted to receive the tabs of similar rails, to permit compact nesting for storage and shipping. The assembly requires use of a special locking tool that has a cutting tooth which cuts a ribbon in a vane wall to form an integral locking clip for securing the vanes to rails.

Myers, U.S. Pat. No. 4,911,205, Mar. 27, 1990, Apparatus And Method For Duct Vane Mounting: Discloses a duct vane assembly having rails in which a pair of inwardly projecting, rectangular tabs lying in an arc are formed. Each tab is insertably secured in a laterally disposed slot formed near the outer lateral edge of each curved turning vane, the slot being defined by a lateral strap formed in the vane adjacent its end. A finger bent in the end of a rail tab projects into an opening in the vane adjacent the strap to positively retain the vane connected to the rails.

Felson, U.S. Pat. No. 5,068,957, Dec. 3, 1991, Turning Vane Setting Tool: Discloses a device and method for permanently anchoring air turning vanes to manufactured vane rails or runners in duct work systems that utilizes pre-positioning, splitting and bending means combined into one continuous sequence when the tool is applied to the exposed edge of an air turning vane which has been inserted into the slotted depression of manufactured vane rails or runners and is activated by means of a hammer blow or similar energy source.

Lyons, et al., U.S. Pat. No. 5,181,314, Jan. 26, 1993, Apparatus For Manufacturing Air Turning Assembly: Discloses an apparatus and method for forming air turning assemblies. The vanes are conventional bowed rectangular sheets, the lateral edges of which are secured in slotted projections on the inner surface of each rail by chisel lips entering the slots in projections and bending over the edges of the vane protruding therethrough.

The Gracer, Felson and Lyons, et al. patents all disclose a turning vane and rail construction which requires the formation of slotted depressions in the rails to secure the vanes thereto. The Hinden '379 patent discloses a turning vane assembly which uses tabs projecting outward from the perimeter of an aperture through a flat rail which are compressed by a locking cam against the perimeter of a compressible vane protruding through the aperture. The Hinden '262 patent discloses the use of a U-shaped compression bracket protruding inwards from a rail and attached thereto by a pop rivet to compress the end of a resilient vane, to which it is secured by another pop rivet. DeLord discloses a rail for a turning vane assembly that utilizes tabs bent inwards from apertures in the rail to attach to an integral locking clip formed in the end wall of a vane by a special tool. Myers discloses a vane and rail construction which utilizes a strap formed near each end of a vane by a laterally disposed slot, the slot insertably receiving a tab bent out from an aperture formed in a rail and secured to the vane by a finger bent out from the end of the tab.

Vane and rail assemblies known to the present inventor, including those cited above, generally require that portions of sheet metal vanes or rails be deformed by robustly pounding parts thereof, using either a hammer, chisel, or specially designed tools, to fasten the vanes and rails together. Sometimes, pounding on a vane and rail assembly to install a series of vanes can loosen the fastening of vanes installed earlier. Then, when a completed vane and rail assembly has been installed into a duct work elbow; and the latter installed in a building, variations in the pressure of air flowing through the duct work can cause the "cheeks" or walls of curved transition sections to expand and contract, and perpendicular duct walls to flex inward and outward or "oil-can" in response to air pressure fluctuations. Since environment control systems for buildings require that air flow rate be turned on and off intermittently, or varied by control dampers, duct work air turning vane assemblies are routinely subjected to such wall deformations. As a result, vanes which had been initially loosened during the fabrication of a turning vane and rail assembly can become completely detached from the rails long after duct work has been installed in a building. As can be readily appreciated, replacing dislodged turning vanes can be an extremely time consuming, laborious and expensive process, particularly in high-rise buildings.

The present invention was conceived of to provide an improved air turning vane and rail assembly of simplified construction and greater versatility than existing assemblies, in which vanes self-lock into engagement with rails, thereby minimizing the likelihood of vanes dislodging from a vane and rail assembly.

OBJECTS OF THE INVENTION

An object of the present invention is to provide an air turning vane and rail assembly for promoting laminar air flow at locations within ventilating duct work in which a change in air flow direction occurs, in which vanes may be fastened securely to rails, without requiring any tool for the fastening operation.

Another object of the invention is to provide an air turning vane and rail assembly including double plate air-foil vanes which are elastically deformed to grip a wedge-shaped rail tab inserted into the space between front and rear plates of the air-foil.

Another object of the invention is to provide an air turning vane and rail assembly in which each of the vanes thereof has an integrally formed locking ear adapted to lockingly engage a perforation through a tab bent up from a rail.

Another object of the invention is to provide an air turning vane having a locking ear formed integrally in a transverse edge wall thereof.

Another object of the invention is to provide an air turning vane and rail assembly having self-locking vanes which may be fastened without the use of tools to planar tabs protruding upwards from the plane of the rail, with a convex surface of the vane facing in either of two opposed longitudinal directions of the rail.

Another object of the invention is to provide double-plate, airfoil cross-section turning vanes having a locking ear formed in a first transverse edge wall of one of the vane plates, the ear being adapted to lockingly engage a perforation formed in an upstanding rail tab.

Another object of the invention is to provide an air turning vane and rail assembly including double-plate air-foil turning vanes having a locking ear formed in a first transverse edge wall thereof lockingly engaged in a perforation formed in a tab protruding from a first rail, and a locking ear formed in a second transverse edge wall thereof lockingly engaged in a, perforation formed in a tab protruding from a second rail.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved air turning vane and rail assembly for promoting laminar air flow at locations within heating, ventilating or air conditioning ("HVAC") duct work where the air flow direction must change, as for example, within an elbow bent at 90 degrees or other angle. According to the present invention, an improved turning vane and rail assembly for promoting laminar air flow is provided, in which vanes may be fastened to rails without requiring the use of tools. Thus, vane and rail air turning assemblies according to the present invention may be readily assembled at job sites from compact packages of rails and vanes.

Preferred embodiments of an improved air turning vane and rail assembly according to the present invention include a double-plate, airfoil-type turning vane. According to the invention, the turning vane has an arcuately curved, convex front airfoil plate joined at opposite longitudinal edge walls thereof to a concave rear airfoil plate having less curvature, i.e., a larger radius of curvature than the front plate.

Air turning vanes thus described are attached to a pair of flat elongated rectangular sheet metal rails, perpendicularly disposed between the rails, in a novel construction described below.

According to the present invention, each of the two rails of an air turning assembly comprises an elongated rectangular strip of sheet metal in which a plurality of generally polygonally-shaped perforations have been made at regular longitudinal intervals along the strip. Each deformation has a modified trapezoidal shape, defined by laterally symmetric, wedge-shaped trapezoidal upper portion, and a laterally elongated, rectangular portion pedestal. The base of the rectangular lower portion of the perforation is left uncut, and serves as a self-hinge or fold line on which a generally trapezoidally-shaped tab is bent perpendicularly outwards from the plane of the strip.

According to the present invention, each trapezoidal rail tab has a pair of relatively long, laterally opposed outwardly and downwardly sloping edge walls, each joined at the lower end thereof to a short, vertically disposed edge wall of a rectangular pedestal. The lateral spacing between the upper portion of the sloping edge walls of each tab is less than the lateral spacing between the inner facing surfaces of the front and rear airfoil plates, allowing the upper end of the tab to be insertably received in the opening between the front and rear airfoil plates. However, the widths of lower portions of the trapezoid and the pedestal are greater than the lateral spacing between inner walls of the front and rear airfoil plates. Thus, when a turning vane is pushed downwards sufficiently far over an insertably received rail tab, both front and rear airfoil plates are deformed laterally outwards to a flatter contour having a smaller curvature. Wedging action of a rail tab inserted into the space between the front and rear airfoil plates is facilitated by the sloping, wedge-shaped side walls of the rail tab.

According to the invention, both front and rear plates are made of a thin, flexible but reasonably stiff material such as sheet steel, which possesses a substantial degree of elasticity when bowed. This elasticity produces a negative hoop tension on both plates, i.e., a force directed radially inwards towards the center of curvature of the plates, which causes both plates to attempt to assume the larger curvatures which they had prior to being deformed by the wedging action of a rail tab. These hoop tension forces cause those portions of the front inner airfoil plate surfaces in contact with the tab side walls to exert a radially inwardly directed gripping force on the tab side walls. The hoop tension forces on the tab side walls also have rearwardly directed force components which force the rear face of tab into abutting contact with the front convex face of the rear air foil plate. These forces combine to tightly grip the tab, thereby securing the vane to the tab.

According to another aspect of the invention, a locking ear is formed in each opposite transverse edge wall of one plate of a vane. Thus, a locking ear is formed in each opposite transverse edge wall of the rear airfoil plate by a pair of longitudinally disposed cuts extending inwards from an edge wall, the cuts defining therebetween a rectangularly-shaped ear which may be bent forwards towards the front airfoil plate.

In embodiments of the invention employing locking ears, a small rectangular aperture is provided through the thickness dimension of each trapezoidally-shaped tab, above the fold line, for receiving a vane ear. These ear-receiving apertures are most conveniently formed in rail sheet stock prior to bending up the tab.

While a vane provided with ears is being pushed down on a tab, the transversely disposed ear protruding inwards from the rear air face plate is forced against a vertical wall surface of the rail tab. When the ear encounters the aperture formed through the tab near its base, the hoop spring tension in the front and rear airfoil plates, which tends to restore both plates to their initial greater curvature before being wedged against by the rail tab, causes the ear to snap into the aperture in the rail tab. Engagement of the vane ear within the rail tab perforation securely locks the vane to the rail.

After a vane has been thus installed on each upstanding tab of a lower rail, an identical upper rail, turned upside down so that its tabs protrude downwards, may be attached to the upper ends of each upstanding vane by aligning the tabs downwardly protruding from the upper rail with corresponding upper openings in the vanes, and pushing downwards on the upper rail to wedgingly engage each vane by an upper tab. Notably, vane and rail assemblies according to the present invention, as described above, may be assembled on a job site from pre-manufactured vanes and rails by hand pressure alone, without requiring any tools.

DESCRIPTION OF THE PREFERRED EMBODIMENTS

Referring now to FIGS. 1–18, novel air turning assemblies with self-gripping vanes according to the present invention are shown.

Figure 1:
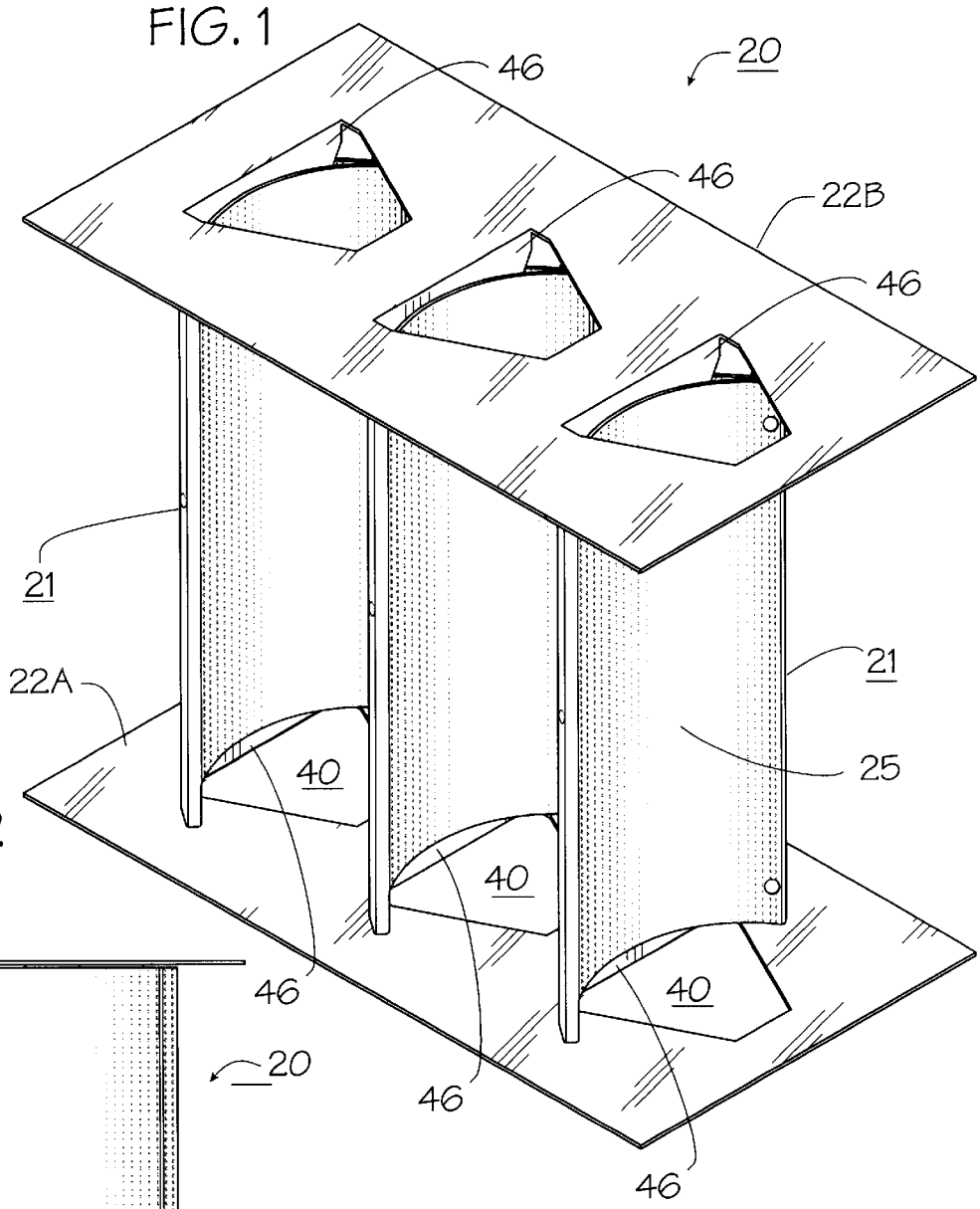
FIG. 1 is a rear perspective view of a basic embodiment of an air turning vane and rail assembly with self-gripping vanes according to the present invention.
Figure 2:
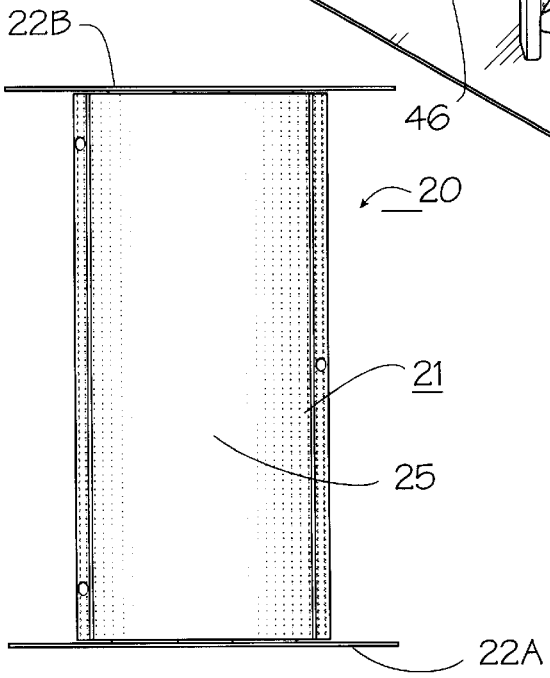
FIG. 2 is a rear elevation view of the assembly of FIG. 1.
Figure 3:
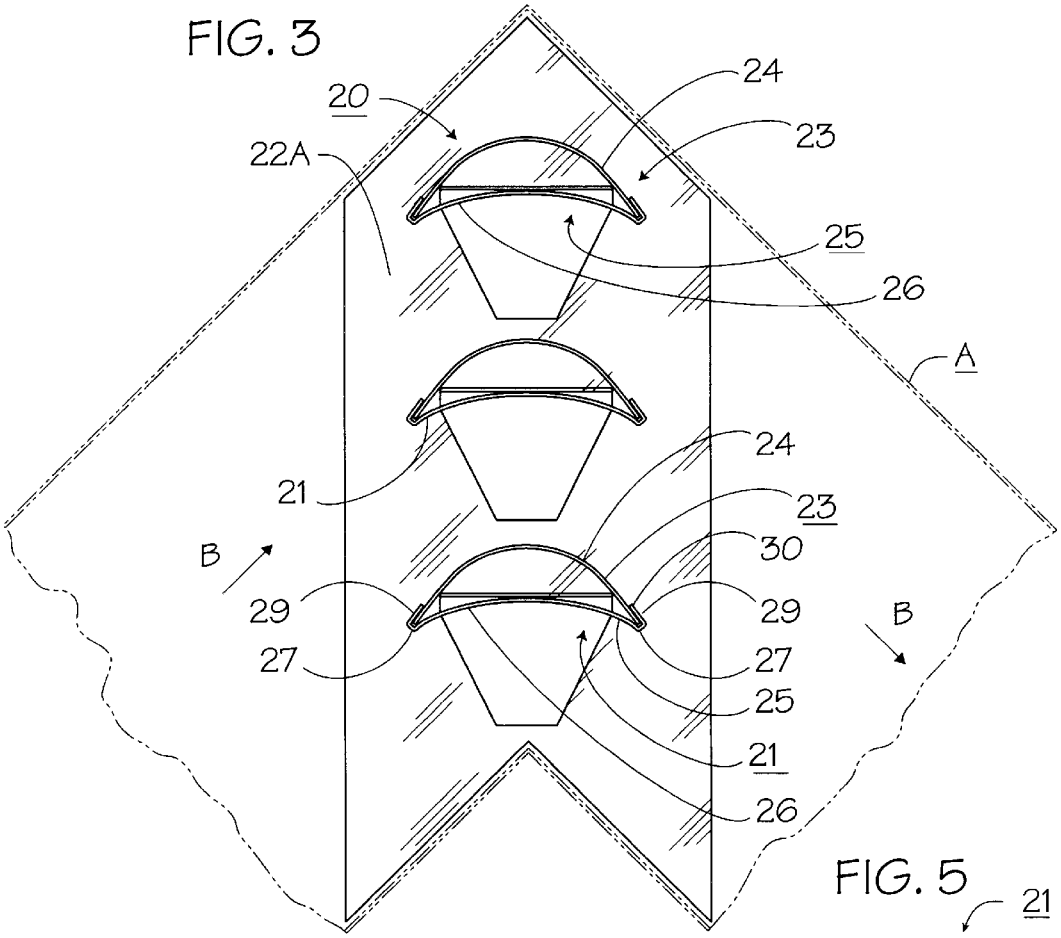
FIG. 3 is an upper plan view of an air turning vane and rail assembly similar to, that shown in FIG. 1, but with the upper rail thereof removed to show orientations of vanes relative to air flow direction.

FIGS. 1–7 depict a basic embodiment of an air turning vane and rail assembly according to the present invention. As shown in FIGS. 1 and 3, air turning vane and rail assembly 20 includes a plurality of thin, double walled arcuately curved air turning vanes 21 perpendicularly disposed between a pair of generally flat, longitudinally elongated rectangular upper and lower rails 22.

FIG. 3 shows a partly assembled vane and rail assembly 20 installed in a right-angle duct work elbow A. Air flow directions in the elbow are indicated by arrows B.

Figure 5:
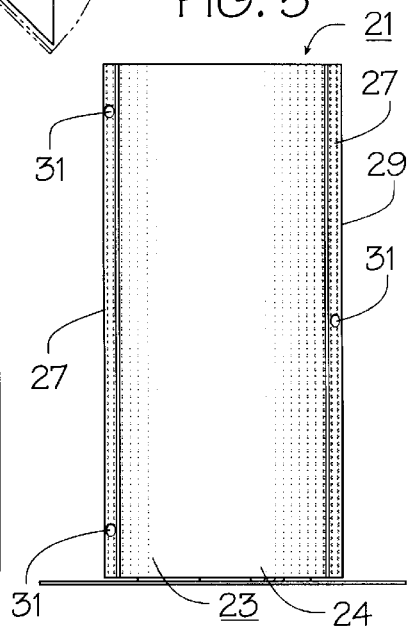
FIG. 5 is a front elevation view of a turning vane comprising a component of the assembly shown in FIGS. 1–4.

Referring to FIGS. 2 and 5, in addition to FIG. 3, each turning vane 21 may be seen to include a front, arcuately curved rectangular plate 23 having a front convex surface 24. Front plate 23 is joined at the longitudinal edges thereof to a rear, arcuately curved rectangular plate 25, having a rear concavely curved surface 26.

As will be described below, front and rear vane plates 23 and 25 are fabricated from sheet stock having a certain degree of elasticity, such as 22 gauge to 24 gauge galvanized G90 sheet steel.

As shown in FIGS. 2, 3 and 5, rear plate 25 of turning vane 21 has a generally rectangular shape with thin longitudinal margins 27 that are folded or rolled over towards the front convex surface 28 of the rear plate, forming radiused longitudinal edge walls 29. Front plate section 23 of vane 21 has a plan view shape similar to that of rear plate section 25. However, front plate section 23 has a curved width or maximum chord length slightly less than the curved width or chord length of rear plate section 25. Longitudinal margins 30 of front plate 23 are sandwiched between the inner surface of folded-over margin 27 of rear plate 25, and front convex surface 24 of the front plate. Preferably, as shown in FIGS. 5 and 7, one or more dimples 31 are punch-formed in the front surfaces of margins 27 of rear plate section 25, the dimples protruding into margins 30 of front plate 23, and into the rear and front surfaces of the rear plate.

As has been described above, turning vane 21 consists of a front plate 23 having a convexly curved front or outer surface 24, and a rear plate 25 spaced rearward from the front plate having a rear or inner concave surface 26 of less curvature than front convex surface 24. Thus, the double wall or double-plate construction of vane 21 has the shape of an airfoil, in which air flow velocity over longer, convex front surface 24 is greater than the flow velocity over shorter, rear concave surface 26. This construction facilitates laminar air flow within duct A. Moreover, the double-plate, airfoil-type construction provides greater structural rigidity to vane and rail assemblies than single-plate vanes.

As shown in FIG. 1, air turning vanes 21 according to the present invention are fastened at the upper and lower transverse edges thereof to a pair of parallel, elongated flat upper and lower sheet metal rails 22. The construction of rails 22 which permits vanes 21 to be fastened to rails 22 without use of tools may be best understood with reference to FIGS. 8–10.

Figure 4:
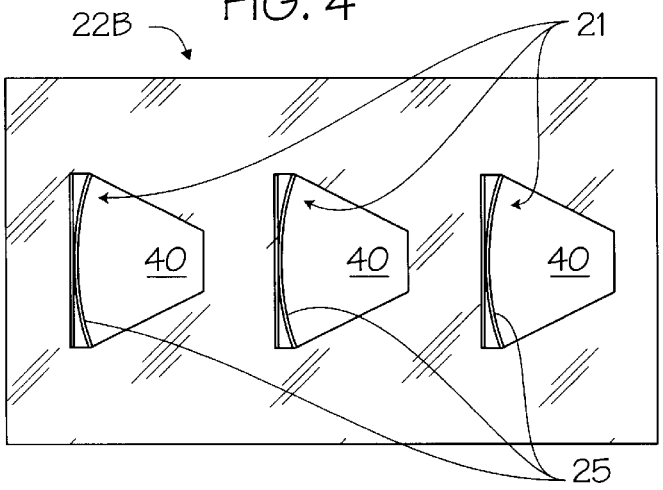
FIG. 4 is a lower plan view of the assembly of FIG. 3.
Figure 6:
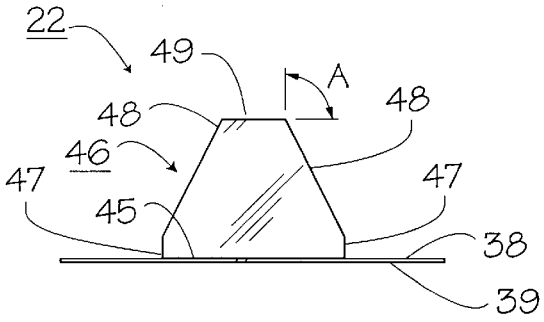
FIG. 6 is a front elevation view of the rail of FIG. 1.
Figure 7:
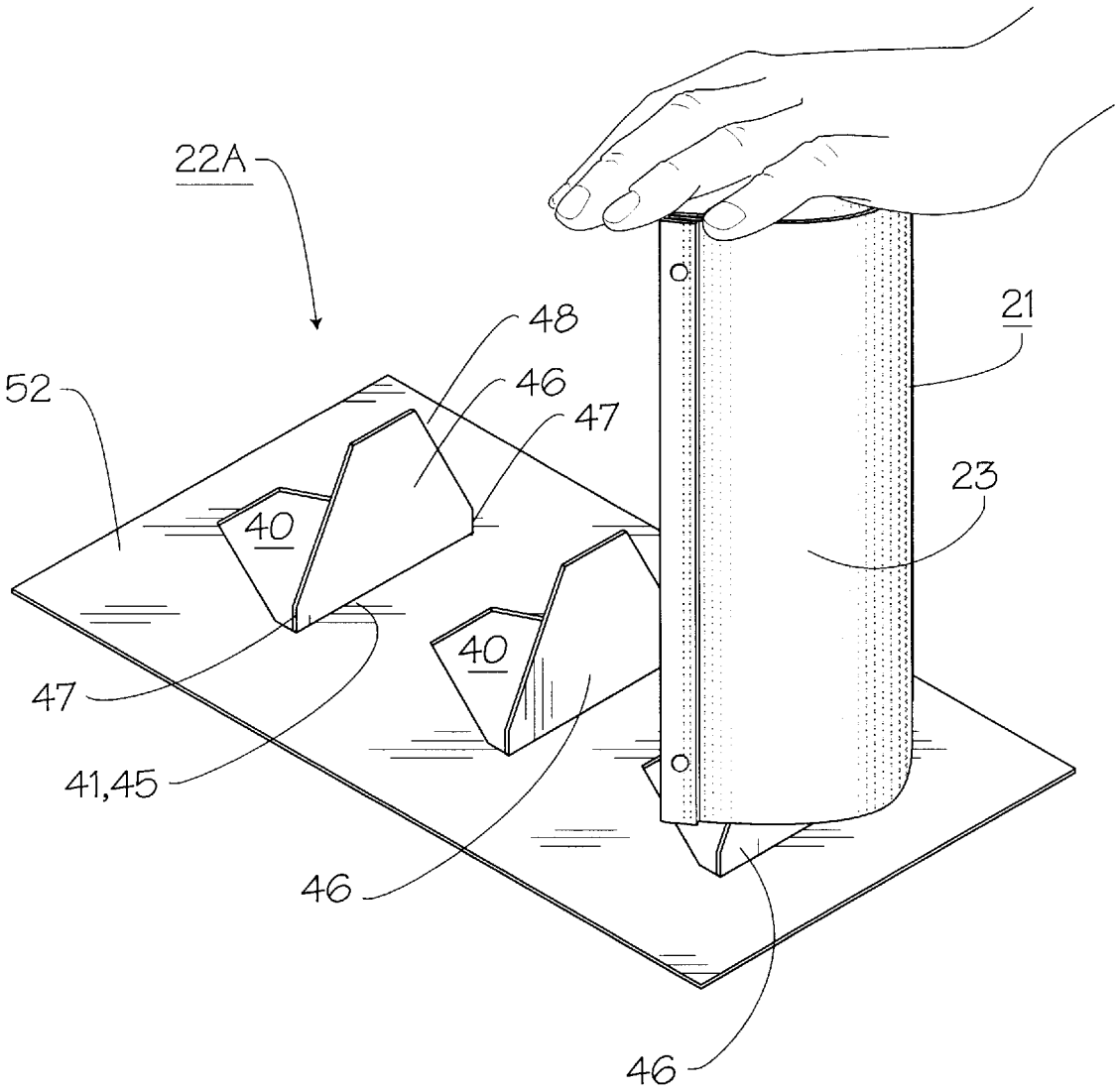
FIG. 7 is a perspective view showing the manner of attaching vanes to a first lower rail in fabricating an air turning vane and rail assembly according to the present invention.
Figure 10:
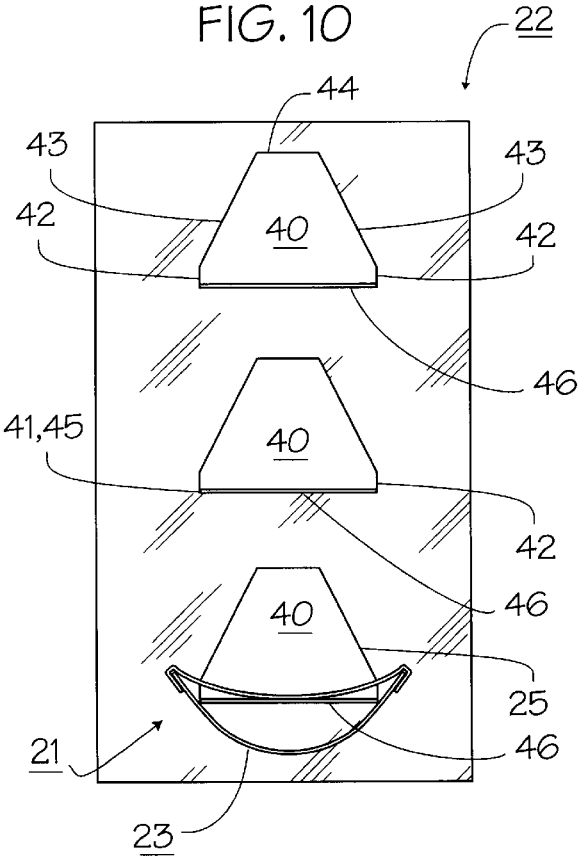
FIG. 10 is an upper plan view of a rail comprising a component of an air turning vane and rail assembly according to the present invention.
Figure 11:
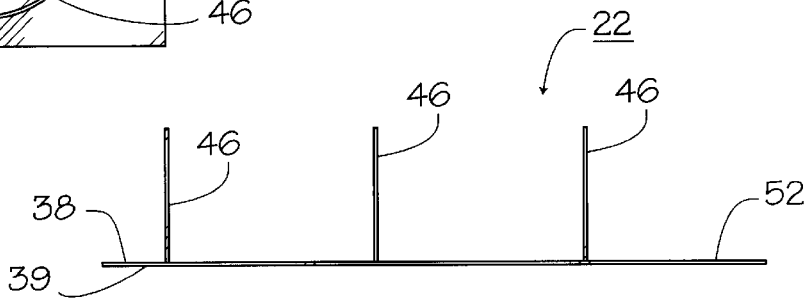
FIG. 11 is a side elevation view of the rail of FIG. 10.

Referring now to FIGS. 4, 6 and 7, rail 22 may be seen to have an elongated rectangular plan view outline defined by flat and parallel upper and lower walls 38 and 39. As may be seen best by referring to FIG. 10, rail 22 has formed through the thickness dimension thereof a plurality of generally trapezoidally-shaped perforations 40. Each rail perforation has the shape of a regular trapezoid, symmetrically disposed about the longitudinal center line of the rail and resting conformally on a short, laterally elongated, rectangularly-shaped pedestal. Thus, rail perforation 40 includes a transversely disposed base 41, laterally opposed straight pedestal sides 42 depending perpendicularly upwards from the base, a pair of laterally opposed straight, obliquely inwardly and upwardly angled oblique walls 43, and an upper edge wall 44 parallel to base 41. As shown in FIGS. 7 and 11, base 41 of perforation 40 is not severed, leaving an uncut fold line 45, on which generally trapezoidal-shaped tab 46 may be folded outward from the plane of rail 22. Thus, as shown in FIGS. 7 and 11, tab 46 is folded upwards out of perforation 40 at 90 degrees to the plane of rail 22, into a vertically upwardly disposed position.

As shown in FIGS. 6 and 7, trapezoidally-shaped tab 46 has a base 45, perpendicular pedestal side walls 47, oblique upper walls 48, and top wall 49 parallel to base 45.

Referring now to FIGS. 1, 3, 4, 7, 11 and 13, the novel method of assembling a turning vane and rail assembly 20 utilizing vanes 21 and rails 22, constructed as described above, will now be described.

Figure 14:
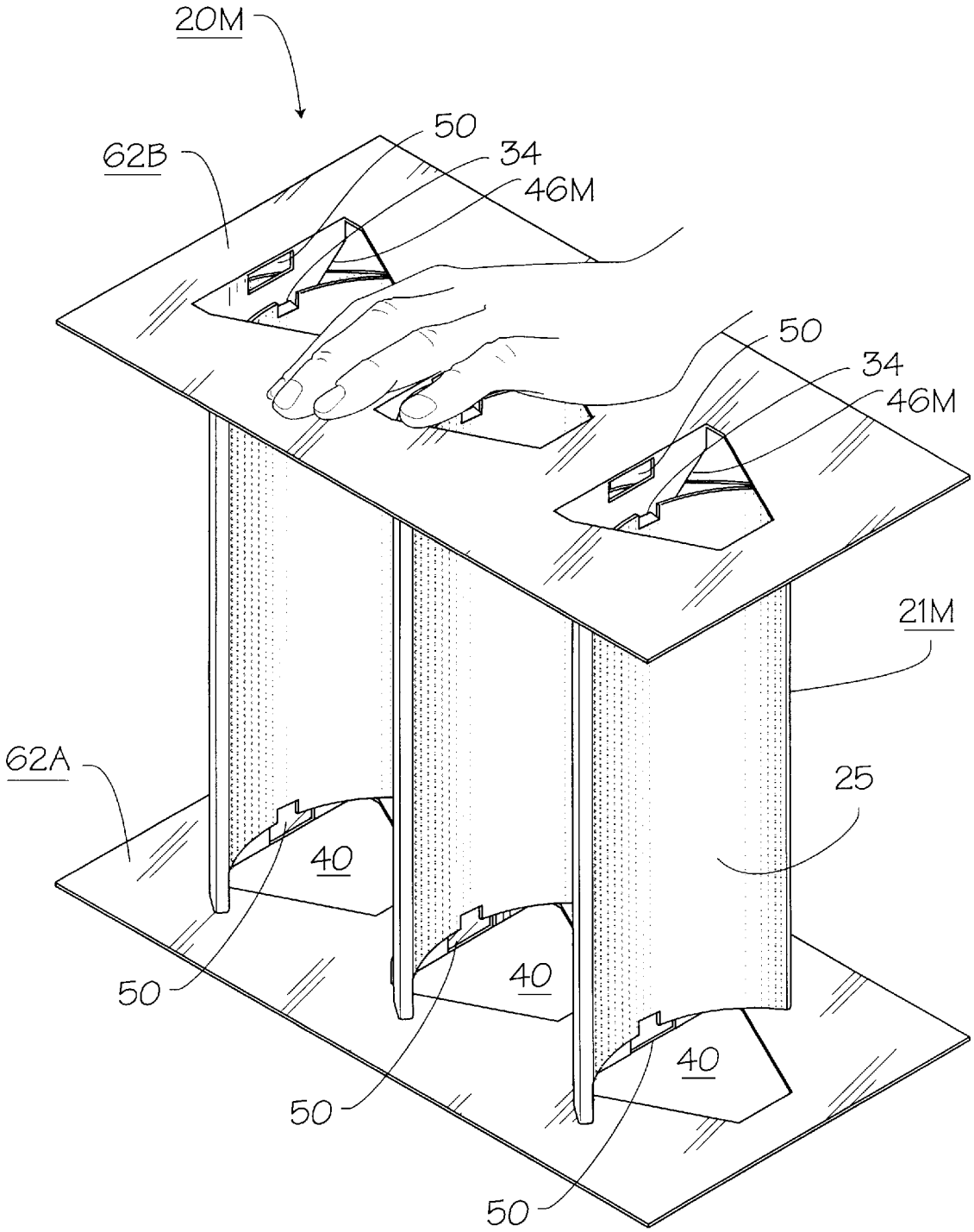
FIG. 14 is a perspective view showing the manner of attaching a second, upper rail to a partial, lower rail and vane sub-assembly.

As shown in FIG. 7, according to the present invention, a plurality of vanes 21 are first fastened to a first, lower rail 22A to construct a partially completed vane and rail assembly 20, as shown in FIG. 3. Then, as shown in FIG. 14, which depicts a modification of the basic embodiment, but which employs the same assembly method, a second, upper rail 22B (analogous to rail 62B in FIG. 14) is fastened in the same way to the upper ends of a plurality of vanes 21 attached to lower rail 22A to construct a complete air turning vane and rail assembly as shown in FIG. 1.

Referring now to FIG. 7, a vane 21 is shown positioned above a tab 46 protruding upwards from base 52 of rail 22, with the vane pushed downwards sufficiently far for the sloping upper walls 48 of the tab to wedgingly contact the inner or rear concave surface 26 of front airfoil plate 23. Then, as shown in FIG. 7, the palm of a person's hand may be used to force vane 21 further downwards, while the other hand maintains the vane perpendicular to rail 22. As sloping tab walls 48 wedge against concave inner surface 26 of front vane plate 23, the chordal line defining the contact points between the sloping tab walls and the inner surface of the vane plate lengthens, thereby deforming the front plate to have a flatter, less curved contour. Since longitudinal margins 37 of rear plate 25 are crimped tightly onto margins 30 of front plates 23, deformation of the front plate margins outwards in response to the wedging action of sloping side walls 48 of tab 46 causes the margins of the rear plate to also deform outwardly.

Vane 21 is forced downwards on tab 46 sufficiently far for the lower transverse edge of the vane to contact the upper surface of flat base 52 of rail 22. At this position, negative hoop tension on front plate 23 and rear plate 25 resulting from the elasticity of the sheet steel from which they are made, causes both plates to bend to assume the larger curvatures they possessed prior to being deformed by the wedging action of tab 46. This elasticity causes the vertical side walls 47 of tab 46 to be firmly gripped by the contacting inner, rear concave surface 57 of front airfoil plate 23. Moreover, the gripping action forces the rear surface of tab 46 against front convex surface 28 of rear airfoil plate 25. Thus, vane 21 is securely fastened to tab 46 of rail 22 by this novel construction.

Figure 13:
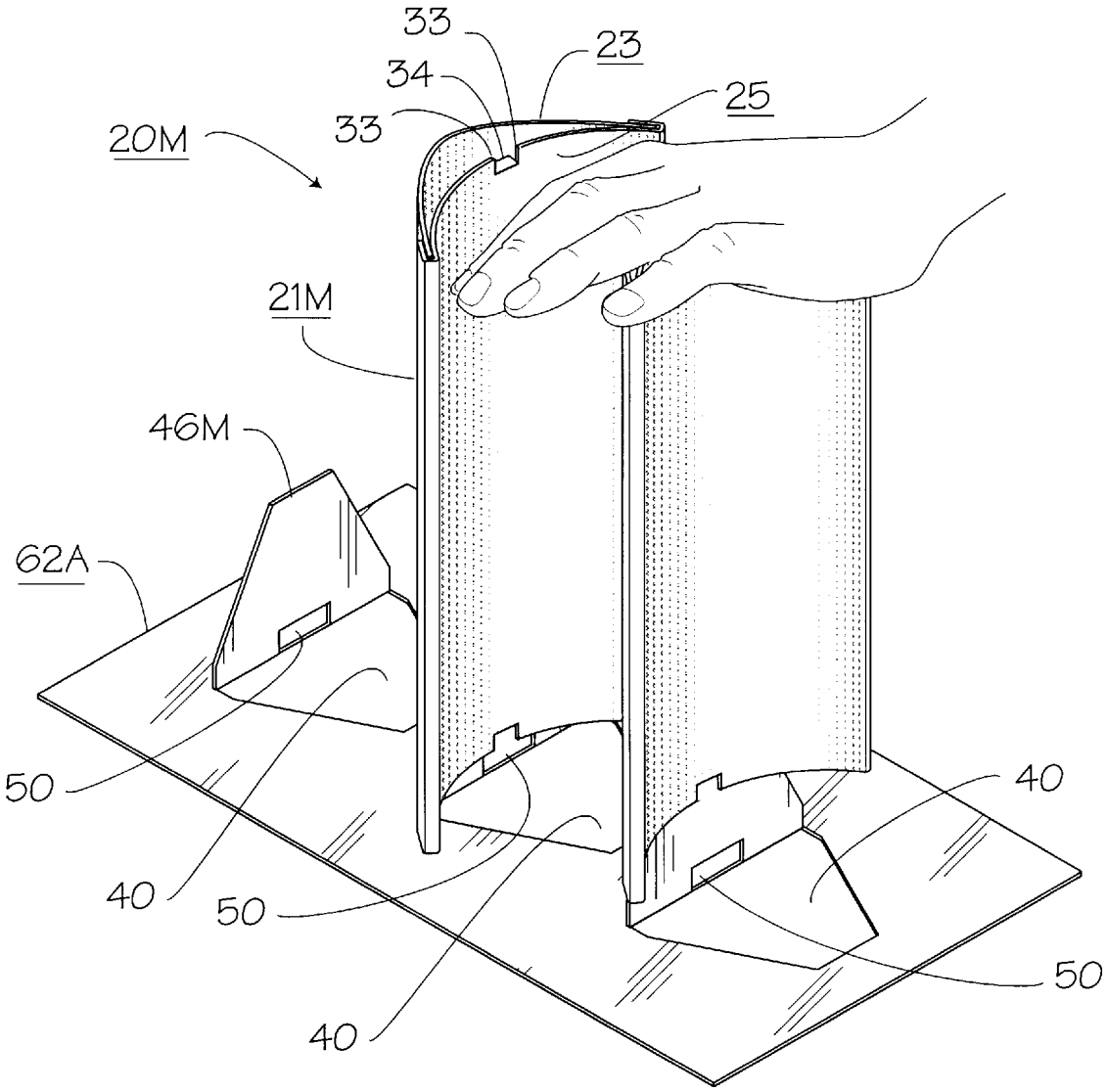
FIG. 13 is a perspective view showing the manner of attaching vanes to a first lower rail of a first modification of an air turning vane and rail assembly according to the present invention.

After a first vane 21 has been fastened to a lower rail 22 in the manner described above, additional vanes may be individually fastened to the lower rail, as shown in FIG. 13. Notably, each of the vanes may be attached to the rail by hand in the manner described above, obviating the necessity for using tools of any kind in the assembly operation.

Fastening of vanes 21 to each of the upstanding tabs 46 of a lower rail 22A results in the sub-assembly, as shown in FIG. 3. An upper rail 22B may then be attached to the upper ends of the vanes, in the manner illustrated in FIG. 14, and described in more detail below.

Although the precise shape and dimensions of trapezoidal tab 46 relative to the opening between front plate 23 and rear plate 25 of vane 21 are not critical, the present inventors have found that the following dimensions are suitable:

A. Angle between top edge wall 49 and either oblique upper wall 48 of tab 46: 30 degrees±2 degrees.

B. Width of base 46 of tab 46: about 2⅛ inch nominal, for chordal distance of about 2 inches nominal between opposite sides of rear concave surface of front airfoil plate 23, in transverse plane tangent to front convex surface 28 of rear airfoil plate 25.

C. Height of pedestal side walls 47: ½ inch nominal.

The novel features of a modification of turning vane 21 which provide the vane with a self-locking capability in addition to the novel self-gripping construction described above, may be best understood by referring to FIGS. 8–14.

Figure 8:
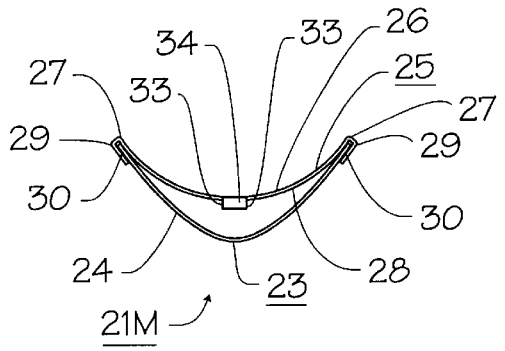
FIG. 8 is an upper plan view of a modified turning vane according to the present invention.
Figure 9:
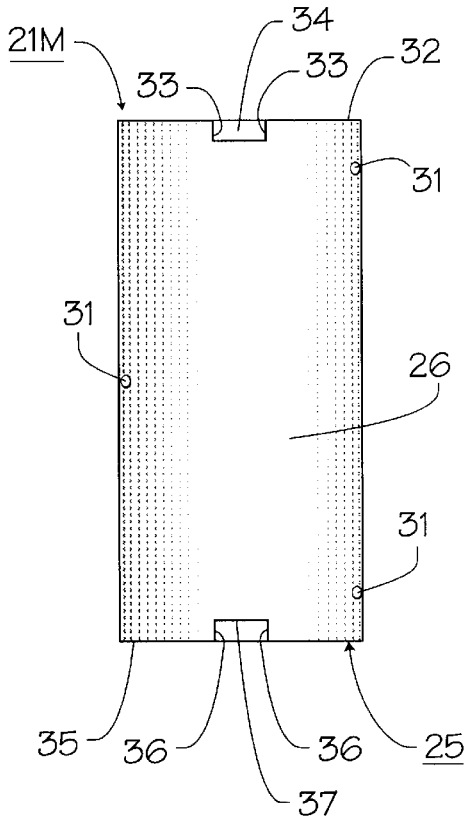
FIG. 9 is a rear elevation view of the turning vane of FIG. 8.

As shown in FIGS. 8 and 9, the upper transverse edge wall 32 of rear plate 25 of a modified air turning vane 21M has formed therein a pair of parallel, longitudinally disposed slits 33 spaced equidistant from the longitudinal center line of the plate. Slits 33 extend a short distance inwards from transverse edge wall 32, and form therebetween a rectangularly-shaped tab or ear 34.

As may be seen best by referring to FIG. 8, ear 34 is bent downwards through slits 33, toward front convex surface 28 of rear vane plate 25. Although the length of ear 34 is not critical, it is preferably about ¼ the perpendicular or maximum radial distance between front and rear plates 23 and 25.

The novel construction of modified air turning vane 21 M, in which an ear is formed in a transverse edge wall of one of the plates thereof, provides vane 21M with a capability for self-locking, tooless attachment to a rail of special construction, as will be described below.

Preferably, both opposite transverse edge walls of a vane plate 25 are provided with ears. Thus, as shown in FIG. 9, lower transverse edge wall 35 of rear vane plate 25 has a lower ear 37 longitudinally aligned with upper ear 34, the lower ear being formed by a pair of lower slits 36 longitudinally aligned with upper slits 33. With ears provided at both upper and lower transverse ends of vane 21m, the vane may be attached to both an upper rail and lower rail, in a novel manner which will now be described.

Referring now to FIGS. 9 and 12–14, it may be seen that modified air turning vanes 21M according to the present invention may be lockably fastened at the upper and lower transverse edges thereof to a pair of parallel, elongated flat upper and lower sheet metal rails 62A and 62B, respectively, which are modifications of rails 22, described above. The construction of modified rails 62 which permits vanes 21M to be lockably fastened to the modified rails, without use of tools, may be best understood with reference to FIGS. 8–10.

Figure 12:
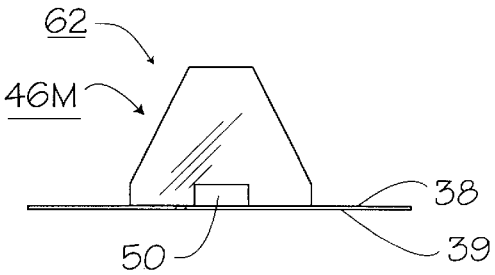
FIG. 12 is a front elevation view of a modified rail according to the present invention.

Referring now to FIGS. 12 and 13, modified rail 62 may be seen to have an elongated rectangular plan view outline defined by flat and parallel upper and lower walls 38 and 39. As may be seen best by referring to FIG. 13, rail 62 has formed through the thickness dimension thereof a plurality of generally trapezoidally-shaped perforations 40. Each rail perforation has the shape of a regular trapezoid, symmetrically disposed about the longitudinal center line of the rail and resting on a short, laterally elongated, rectangularly-shaped pedestal. Thus, rail perforation 40 includes a transversely disposed base 41, laterally opposed straight pedestal sides 42 depending perpendicularly upwards from the base, a pair of laterally opposed straight, obliquely inwardly and upwardly angled oblique walls 43, and an upper edge wall 44 parallel to base 41.

As may be seen best by referring to FIGS. 7 and 11, base 41 of perforation 40 is not severed, leaving an uncut fold line 45, on which a generally trapezoidally-shaped tab 46M may be folded outward from the plane of rail 62. As may be seen best by referring to FIGS. 12 and 13, tab 46M is folded upwards at 90 degrees to the plane of rail 62, to a vertically upwardly disposed position.

As shown in FIGS. 12 and 13, modified trapezoidally-shaped tab 46 has a base 45, perpendicular side walls 47, oblique upper walls 48, and top wall 49 parallel to base 45. As shown in FIGS. 10 and 11, tab 46M has formed through its thickness dimension a small, centrally located, laterally elongated rectangular perforation 50 having a lower edge wall coextensive with base 45 of the tab. As may be seen best by referring to FIG. 18, perforation 50 may optionally have a rectangular-shaped extension 51 that penetrates the flat base 52 of rail 22. The function of extension perforation 51 will be described below, following the description of the function of perforation 50.

Referring now to FIG. 13, the novel method of assembling a modified turning vane and rail assembly 20M utilizing modified vanes 21M and modified rails 62, constructed as described above, will now be described.

As shown in FIG. 13, according to the present invention, a plurality of vanes 21M are first fastened to a first, lower rail 62A forming a partially completed vane and rail assembly 20M, as shown in FIG. 13. Then, as shown in FIG. 14, a second, upper rail 62B is fastened in a similar way to the upper ends of a plurality of vanes 21M previously fastened to lower rail 62A.

Referring now to FIG. 13, a vane 21M is shown positioned above a tab 46M protruding upwards from base 52 of rail 62, with the vane pushed downwards sufficiently far for the sloping upper walls 48 of the tab to wedgingly contact the inner or rear concave surface 26 of front airfoil plate 23. Then, as shown in FIG. 13, the palm of a person's hand may be used to force vane 21M further downwards, while the other hand may be used to maintain the vane perpendicular to rail 22, if desired.

As sloping walls 48 of tab 46 wedge against concave inner surface 26 of front vane plate 23, the chordal line defining the contact points between the sloping tab walls and the inner surface of the vane plate lengthens, thereby deforming the front plate to have a flatter, less curved contour. Since longitudinal margins 37 of rear plate 25 are crimped tightly onto margins 30 of front plate 23, deformation of the front plate margins outwards in response to the wedging action of sloping side walls 48 of tab 46M causes the margins of the rear plate to also deform outwardly.

Deformation of rear plate 25 to a flatter contour also occurs because of the rearward force exerted on the front edge wall of ear 34 by the rear face 54 of tab 46M when it is slid downwards in contact with rear face of the tab.

When a vane 21M is forced downwards on tab 46M sufficiently far for the lower transverse edge of the vane to contact the upper surface of flat base 52 of rail 62, ear 34 is located adjacent rectangular perforation 50 through the base of tab 46M. At this position, negative hoop tension on front airfoil plate 23 and rear airfoil plate 25 resulting from the elasticity of the sheet steel from which they are both made, causes both plates to bend in an attempt to assume the larger curvatures they possessed prior to being deformed by the wedging action of tab 46M. Thus, ear 34 springs forward into tab aperture 50 immediately upon encountering the aperture. In this position, the upper or inner surface 54 of ear 34 lodges securely against upper edge wall 55 of tab perforation 50, securely locking vane 21M to rail 62. This elasticity also causes the vertical side walls 47 of tab 46M to be firmly gripped by the contacting inner, rear concave surface 57 of front airfoil plate 25. Moreover, the gripping action forces the rear surface of tab 46M against front convex surface 28 of rear airfoil plate 25. Thus, modified vane 21M is securely fastened to rail 62 by this novel construction, both by gripping and locking actions.

After a first vane 21M has been fastened to a lower rail 62A in the manner described above and shown in FIG. 13, additional vanes may be individually fastened to the lower rail, as shown in FIG. 14. Notably, each of the vanes may be attached to the rail by hand in the manner described above, obviating the necessity for using tools of any kind in the assembly operation.

Fastening of vanes 21M to each of the upstanding tabs 46M of a lower rail 62A results in the sub-assembly shown in FIG. 13. An upper rail 62B is then attached to the upper ends of the vanes, in the manner illustrated in FIG. 14, and described in more detail below.

Referring now to FIG. 14, a second, upper rail 62B is shown in an inverted position overlying the vane and rail sub-assembly of FIG. 13, that sub-assembly comprising a lower rail 62A having a vane 21M lockingly fastened to each tab 46M protruding upwards from the lower rail. A tab 46M protruding downwards from an end of upper rail 62B is inserted into the opening between front and rear plates 23 and 25 of an upstanding vane 21M at a corresponding end of lower rail 62A. Pressure is then applied to that portion of the lower surface of upper rail 62A overlying the end vane 21M, forcing downwardly protruding tab 46M into locking engagement with the upper end of the end vane. As shown in FIG. 14, pressure sufficient to lockingly engage tab 46 with the upper end of vane 21 may be exerted by the palm of a person's hand, without requiring the use of any tools.

After a first, end tab 46M of upper rail 62B has been fastened to the upper end of the end vane 21M of modified vane and rail sub-assembly 20M as described above, each successive tab 46M protruding downwards from the upper rail is lockingly engaged with an ear 34 protruding laterally outwards from the upper end of each successive vane, by mere application of pressure exerted by the palm of a person's hand, as described above. Fastening of the upper end of each vane 21M to upper rail 62B in the manner described above results in a completed modified vane and rail assembly 20M as shown in FIG. 14.

Figure 15:
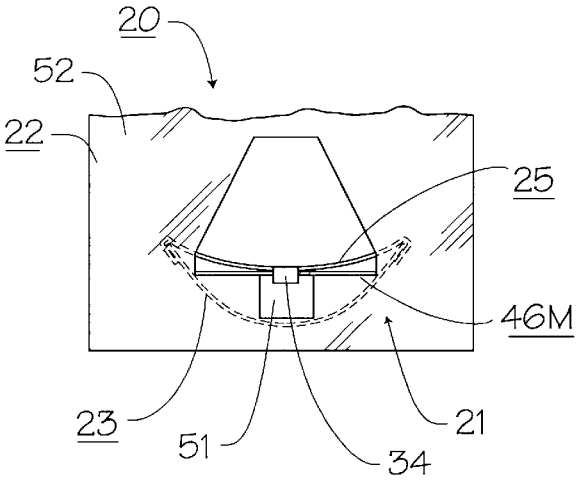
FIG. 15 is a fragmentary plan view of the turning vane and rail assembly of FIG. 1, on an enlarged scale and showing a modified fastening method.
Figure 16:
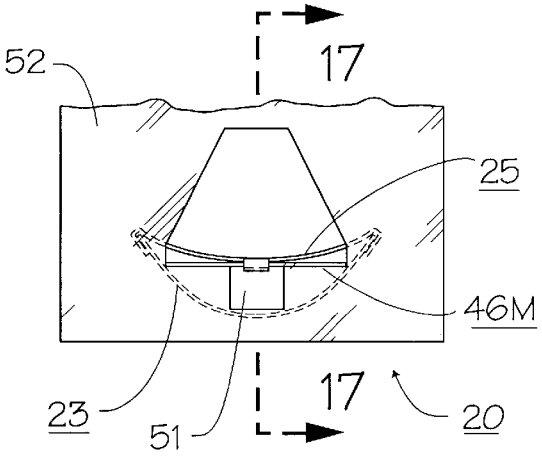
FIG. 16 is a view similar to that of FIG. 15, but showing a vane ear bent over.
Figure 17:
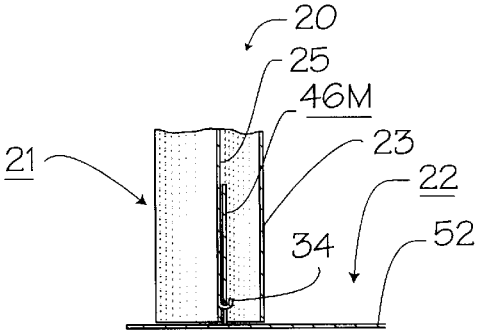
FIG. 17 is a transverse sectional view of the structure of FIG. 16, taken along line 17—17.

As shown in FIG. 15, ear 34 may optionally be bent an additional 90 degrees from its initial perpendicular orientation to front surface 28 of rear plate 25, around upper edge wall 55 of the tab perforation 50. This operation may be facilitated by the optional rectangularly-shaped extension 51 of perforation 50, through rail 62, the extension permitting insertion of screwdriver blade or similar tool used to bend ear 34 towards a direction generally parallel to front convex surface 28 of rear plate 25, as shown in FIGS. 16 and 17, with the vane orientation reversed as shown in FIG. 18 and described below.

Figure 18:
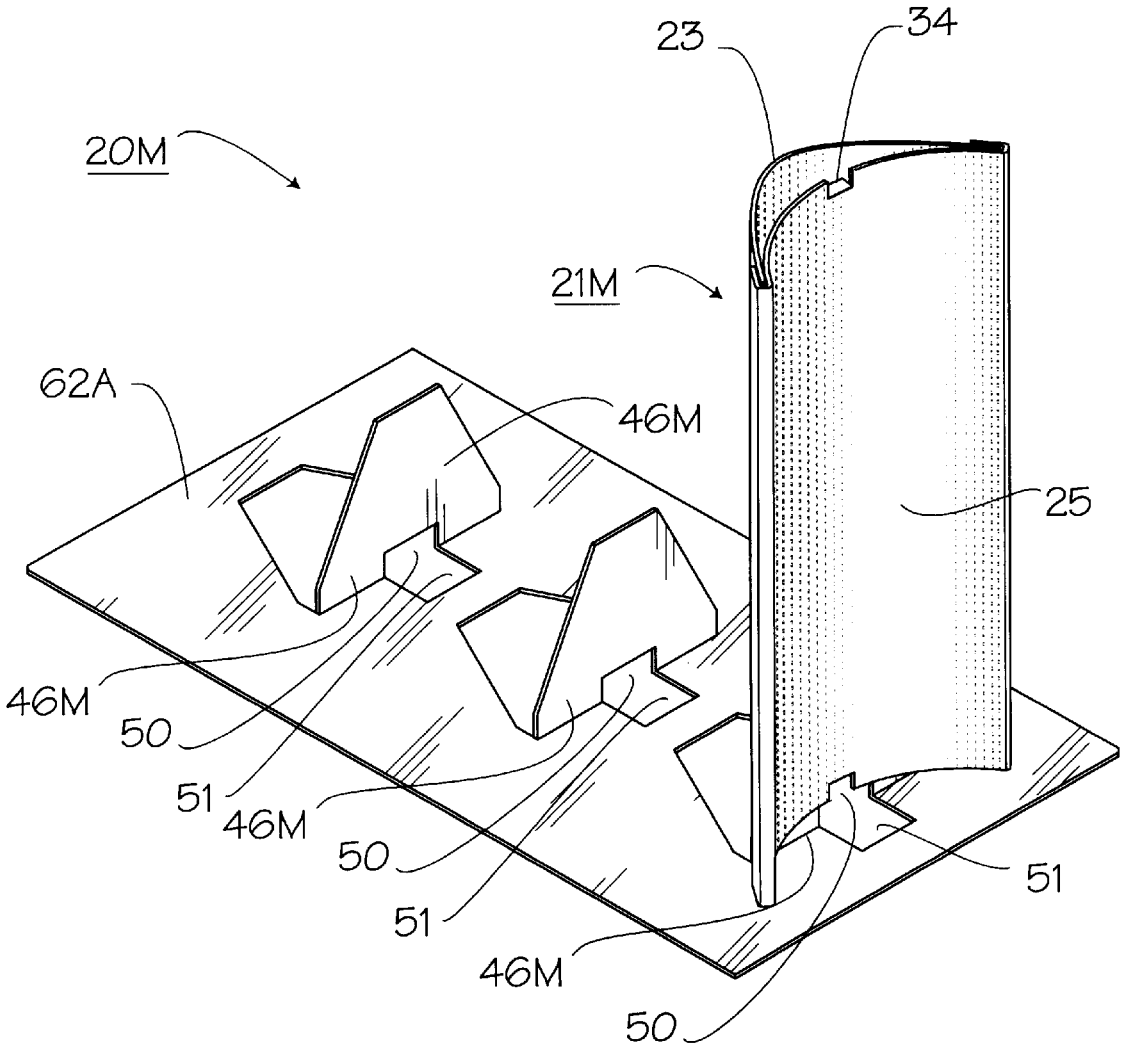
FIG. 18 is a perspective view showing a second modification of an air turning vane and rail assembly according to the present invention, in which orientation of the vanes is reversed.

FIG. 18 shows an alternate orientation of a vane 21 with respect to a rail 22, in which the vane is rotated 180 degrees about its longitudinal axis relative to the orientation shown in the previous figures. Thus, as shown in FIG. 18, vane 21M is oriented with respect to rail 62 so that ear 34 is adjacent front face 56 of tab 46, rather than rear face 53.

With vanes 21M oriented with respect to rails 62, as shown in FIG. 13, ear 34 overlies a trapezoidal rail perforation. Thus, for this orientation, no tool-access perforation 51 is required to fold tab 34 over into contact with the front ear face of rear airfoil plates 25.

FIGS. 19–22 illustrate a second modification of a self-gripping air turning vane according to the present invention.

As shown in FIGS. 19–22, modified air turning vane 71 includes a bowed front plate 73 having a convex front surface 74, and a bowed rear plate 75 having a concave rear surface 76. Rear plate 75 has formed therein a pair of longitudinally spaced apart, generally hemispherically-shaped, button-like protuberances 84 and 87 which protrude forward from front convex surface 78 of the rear plate. "Buttons" 84 and 87 are located longitudinally inwards from the upper and lower transverse edge walls 82 and 85, respectively, of rear plate 75.

Figure 20:
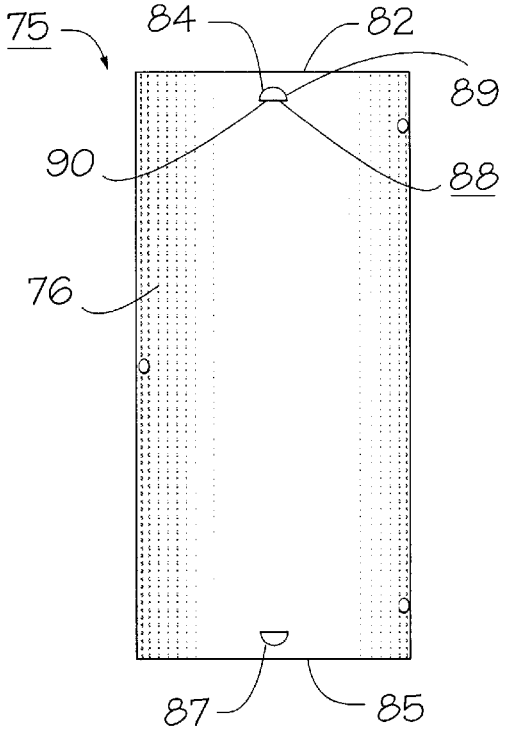
FIG. 20 is a rear elevation view of the turning vane of FIG. 19.

As may be seen best by referring to FIG. 20, each button 84 and 87 may be fabricated by forming in the rear concave surface 76 of rear plate 75 a depression or indentation 88 having an arcuately curved convex outer edge 89, proximate an outer transverse edge wall 82 or 85 of the rear plate, and a straight, transversely disposed inner chordal edge 90.

Figure 19:
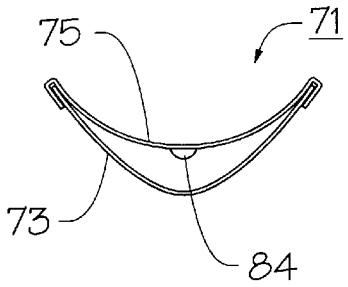
FIG. 19 is an upper plan view of a second modification of a self-gripping air turning vane according to the present invention.
Figure 21:
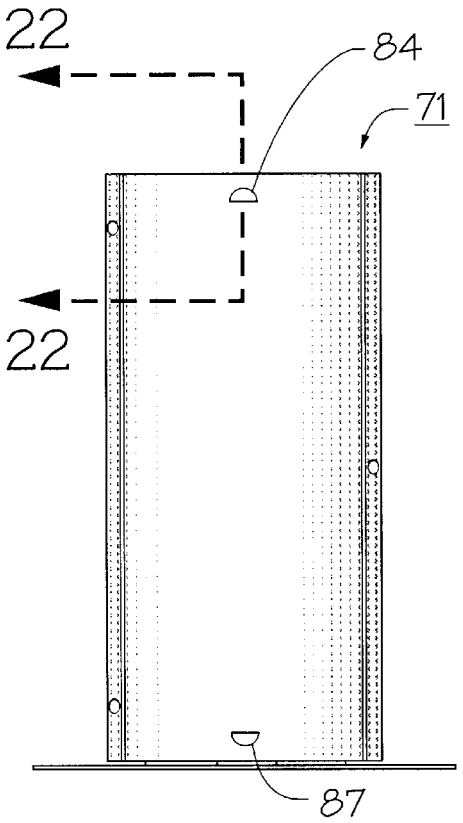
FIG. 21 is a fragmentary, broken-away front elevation view of the turning vane of FIG. 19, on a somewhat enlarged scale.
Figure 22:
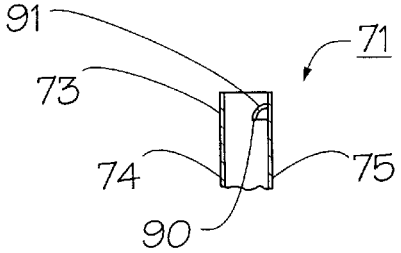
FIG. 22 is a transverse sectional view of the turning vane of FIG. 21, taken along line 21—21.

As may be seen best by referring to FIG. 21 in addition to FIG. 20, inner chordal edge 90 of indentation 88 preferably pierces rear plate 75. In any event, as shown in FIGS. 19, 21 and 22, buttons 84 and 87 each protrude forward from front convex surface 78 of rear plate 75 and have a longitudinally outwardly disposed convex, generally hemispherically-shaped surface 91, and an inner transversely disposed lip 90. Thus constructed, when modified vane 71 is forced downwards on a tab 46M, the outer hemispherically-shaped surface 91 of a button 84 or 87 slides along the surface of the tab until lip 90 of the button encounters aperture 50 through tab 46. At this position, button 84 or 87 springs forward into tab aperture 50, and lip 90 locks securely against upper edge wall 55 of tab perforation 50. To further secure engagement of tab edge wall 55 by button lip 90, the button lip may be angled towards an adjacent lateral edge of rear vane plat 75, at an angle of about 82 degrees to 85 degrees to rear surface 76 of the rear vane plate, rather than the 90-degree angle depicted in FIG. 22.

Figure 23:
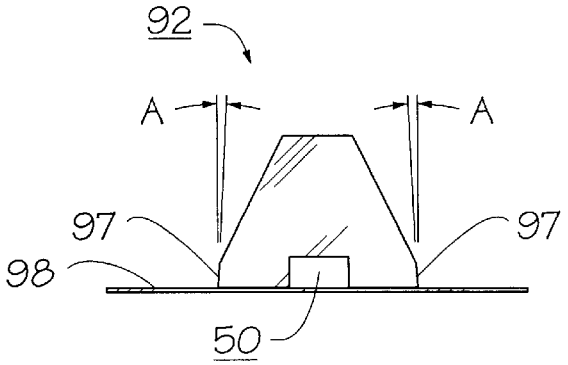
FIG. 23 is a front elevation view of a modified rail for a self-gripping air turning vane and rail assembly according to the present invention.

FIG. 23 is a front elevation view of a second modification of a rail for an air turning vane and rail assembly according to the present invention. Modified rail 92 is substantially similar in construction to modified rail 62 shown in FIG. 12 and described above. However, tab 96 of modified rail 62 has side edge walls 97 which are inclined slightly inwards from a normal to the upper surface 98 of the rail, towards the vertical center line of the tab. The purpose of the inclination of tab side walls 97 is two fold. First, the inward inclination of the edge walls facilitates insertion of tab 92 into a vane. Second, the inclination of the side walls 97 of tab 92, which tabs are bent out of perforations having the same inner perimeter shape as the outline shape of a tab, facilitates vertical stacking of a plurality of rails, with each tab of lower rail protruding upwardly through the tab aperture of an upper rail, and the respective tabs adjacent to and in longitudinal alignment with each other. In the preferred embodiment, side walls 97 are each inclined inwards at an angle of 3 degrees±1 degree from the vertical.

What is claimed is:

1. An air turning assembly for promoting laminar air flow in angled duct work transition sections comprising;

a a first, elongated base rail having formed through the thickness dimension thereof a plurality of longitudinally spaced apart polygonally-shaped cuts, each terminating in a straight uncut polygon base on which base a polygonally-shaped tab is folded out of said cut and the plane of said cut to comprise a plurality of polygonally-shaped tabs which protrude upwards from said rail, each of said tabs having therethrough a perforation located near the intersection of said tab with said rail, and having a trapezoidally-shaped upper portion and a rectangularly-shaped base portion having a pair of laterally opposed side walls which are inclined inwards at an angle towards a longitudinal center line of said tab, and b a plurality of air turning vanes, one each attached to each of said tabs, each of said turning vanes comprising a vertically elongated structure of generally uniform transverse cross section including a thin, flexible, front airfoil plate having a generally rectangularly shaped plan view, and an arcuately curved, convex front surface, said front airfoil plate being joined at opposite longitudinal edge walls thereof to a thin, flexible, rear airfoil plate having a generally rectangularly-shaped plan view and an arcuately curved, concave rear surface having a larger radius of curvature than said front airfoil plate, said vane having a first, lower opening defined between said front and rear airfoil plates, said lower opening having a maximum transverse width less than the width of said rail tab, whereby when said rail tab is inserted into said lower vane opening and said vane is pressed downwards on said tab, said front and rear airfoil plates are elastically wedgingly deformed laterally outwards to a flatter contour having a smaller curvature, said deformation producing hoop spring tension in said front and rear airfoil plates which causes the inner surfaces thereof to tightly grip said tab, thereby wedgingly securing said vane to said tab.

2. The air turning assembly of claim 1 wherein said angle is about 3 degrees plus or minus one degree.

3. The assembly of claim 2 wherein said tab is further defined as having laterally opposed outwardly and downwardly sloping edge walls which taper outwards to a width greater than the maximum lateral opening of said lower vane entrance opening.

4. The air turning assembly of claim 3 wherein said vane is further defined as having a second, upper opening defined between said front and rear airfoil plates.

5. The air turning assembly of claim 4 further including a second, upper elongated rail functionally similar to said first, base rail, said upper rail having downwardly protruding tabs, each insertably receivable in one of said second, upper vane entrance openings, and thereby to be wedgingly gripped by said vane.

6. An air turning assembly for promoting laminar air flow in angled duct work transition sections comprising;

a. a first, elongated base rail having protruding upwards therefrom a plurality of longitudinally spaced apart tabs, each of said tabs having therethrough a perforation located near the intersection of said tab with said rail, and b. a plurality of air turning vanes, one each attached to each of said tabs, each of said turning vanes comprising a vertically elongated structure of generally uniform transverse cross section including a thin, flexible, front airfoil plate having a generally rectangularly shaped plan view, and an arcuately curved, convex front surface, said front airfoil plate being joined at opposite vertical edge walls thereof to a thin, flexible, rear airfoil plate having a generally rectangularly-shaped plan view and an arcuately curved, concave rear surface having a larger radius of curvature than said front airfoil plate, said rear airfoil plate having formed proximate a lower, transverse edge wall thereof a first protuberance protruding forward towards said front airfoil plate, said vane having a first, lower opening defined between said front and rear airfoil plates, said lower opening having a maximum transverse width less than the width of said rail tab, whereby when said rail tab is inserted into said lower vane opening and said vane is pressed downwards on said tab, said front and rear airfoil plates are elastically deformed laterally outwards to a flatter contour having a smaller curvature, said deformation producing hoop spring tension in said front and rear airfoil plates which causes said protuberance of said rear airfoil plate to spring forward into locking engagement into said tab perforation when said vane is pushed downwards sufficiently far on said tab for said protuberance to become longitudinally aligned with said perforation.

7. The air turning assembly of claim 6 wherein said rail is further defined as having through the thickness dimension thereof an aperture adjacent said tab, whereby a tool may be inserted through said aperture to bend said protuberance towards said tab.

8. The air turning assembly of claim 6 wherein said protuberance is further defined as being an ear formed in said lower transverse edge wall of said rear airfoil plate by a pair of laterally spaced apart cuts made longitudinally inwards/upwards into said lower transverse edge wall, said cuts defining therebetween a short strip of material which is bent forward to form said ear.

9. The air turning assembly of claim 8 wherein said ear is further defined as being generally rectangularly shaped.

10. The air turning assembly of claim 6 wherein said protuberance is further defined as protruding from the front, inner surface of said rear air foil plate.

11. The air turning assembly of claim 10 wherein said protuberance is further defined as having a transversely disposed upper lip.

12. The air turning assembly of claim 11 wherein said protuberance is further defined as having an arcuately curved, convex lower surface.

13. The air turning assembly of claim 6 wherein said protuberance is further defined as being a protruding portion of the front, inner surface of said rear air foil plate.

14. The air turning assembly of claim 13 wherein said protruding portion of said front, inner surface of said rear air foil plate is shaped complementarily to an adjacent indented portion of the rear surface of said rear air foil plate.

15. The air turning assembly of claim 6 wherein said tab is further defined as having a polygonal shape.

16. The air turning assembly of claim 15 wherein said rail is further defined as having formed therein a plurality of longitudinally spaced apart, polygonally-shaped cuts, each terminating at a straight un-cut polygon base on which base a polygonally-shaped tab is folded out of said cut and the plane of said rail to comprise a polygonally-shaped tab.

17. The air turning assembly of claim 16 wherein said polygonally-shaped tab is further defined as being symmetrically-shaped about a longitudinal center line therethrough.

18. The air turning assembly of claim 17 wherein said tab is further defined as having laterally opposed outwardly and downwardly sloping edge walls which taper outwards to a width greater than the maximum lateral opening of said lower vane entrance opening.

19. The air turning assembly of claim 16 wherein said tab is further defined as having a trapezoidally-shaped upper portion.

20. The air turning assembly of claim 19 wherein said tab is further defined as having a rectangularly-shaped base portion.

21. The air turning assembly of claim 6 wherein each of said vanes is further defined as having formed in the second, upper transverse edge wall thereof a second protuberance protruding forward towards said front airfoil plate, below a second, upper entrance opening defined between said front and rear airfoil plates.

22. The air turning assembly of claim 21 further including a second, upper elongated rail functionally similar to said first, base rail, said upper rail having downwardly protruding tabs, each insertably receivable in one of said second, upper vane entrance openings, and thereby to be lockably fastened thereto by said second protuberance engaged by a perforation in said upper rail tab.

23. An air turning assembly for promoting laminar air flow in angled duct work transition sections comprising;

a a first elongated base rail made of a thin sheet of material having formed therethrough a plurality of longitudinally spaced apart polygonal perforations forming a polygonal shaped tab joined by a fold line of unperforated material, said tab being bent upwards on said fold line, out of said perforation, to an upwardly protruding disposition relative to the plane of said rail, each of said tabs having therethrough a perforation located proximate and above said fold line, and b a plurality of air turning vanes, each attached to a separate one of said tabs, each of said turning vanes comprising an airfoil having a front airfoil plate made of a thin sheet of flexible material formed into a convex arcuately curved contour of generally uniform transverse cross-sectional shape, said front airfoil plate being joined at opposite longitudinal edge walls thereof to a rear airfoil plate made of a thin sheet of flexible material formed into an arcuately curved, rearwardly concave shape with a larger radius of curvature than said front airfoil plate, said rear airfoil plate having formed in a first, lower transverse edge wall thereof a first pair of longitudinally upwardly disposed slits defining therebetween a first ear which is bent forward between said slits towards the rear surface of said front airfoil plate, said vane having a first, lower opening defined between said front and rear airfoil plates, said lower opening having a maximum transverse width less than the width of said rail tab, whereby when said rail tab is inserted into said lower vane opening and said vane is pressed downwardly on said tab, said front and rear airfoil plates are elastically deformed laterally outwards to a flatter contour having a smaller curvature, said deformation producing hoop spring tension in said front and rear airfoil plates which causes said ear of said rear airfoil plate to spring forward into said perforation in said rail tab when longitudinally aligned therewith.

24. The air turning assembly of claim 23 wherein said rail is further defined as having through the thickness dimension thereof an aperture adjacent said tab, whereby a tool may be inserted through said aperture to bend said ear towards said tab.

25. The air turning assembly of claim 23 wherein said perforation through said vane has a lower edge coincident with said fold line.

26. The air turning assembly of claim 23 wherein said rail tab is further defined as having upper side walls which slope downwardly and outwardly from the upper edge wall thereof.

27. The air turning assembly of claim 23 wherein each of said vanes is further defined as having formed in the second, upper transverse edge wall thereof a second pair of longitudinally downwardly disposed slits defining therebetween a second ear which is bent forward between said slits towards the rear surface of said front airfoil plate, said vane having a second, upper opening defined between said front and rear airfoil plates.

28. The air turning assembly of claim 27 further including a second, upper elongated rail functionally similar to said first, base rail, said upper rail having downwardly protruding tabs, each insertably receivable in one of said second, upper entrance vane openings, and thereby to be lockably fastened thereto by said second, upper ear engaged by a perforation in said upper rail tab.

* * * * *